US007828909B2

(12) United States Patent
Miyauti et al.

(10) Patent No.: US 7,828,909 B2
(45) **Date of Patent: *Nov. 9, 2010**

(54) MIST GENERATING DEVICE, AND DISHWASHER AND WASHING MACHINE USING SAME

(75) Inventors: Takashi Miyauti, Hyogo (JP); Kazuyoshi Takeuchi, Shiga (JP); Shigeru Matsuo, Osaka (JP); Takayuki Inoue, Hyogo (JP); Hiroaki Inui, Osaka (JP); Makoto Oyama, Osaka (JP)

(73) Assignee: Panasonic Corporation, Osaka (JP)

( * ) Notice: Subject to any disclaimer, the term of this patent is extended or adjusted under 35 U.S.C. 154(b) by 921 days.

This patent is subject to a terminal disclaimer.

(21) Appl. No.: 11/141,311

(22) Filed: Jun. 1, 2005

(65) Prior Publication Data

US 2005/0268668 A1 Dec. 8, 2005

(30) Foreign Application Priority Data

Jun. 4, 2004 (JP) ..... 2004-167442
Jun. 23, 2004 (JP) ..... 2004-184728

(51) Int. Cl.
*A47L 15/42* (2006.01)
*B08B 3/00* (2006.01)
*B08B 3/12* (2006.01)

(52) U.S. Cl. ..... 134/56 D; 134/95.3; 134/186; 134/198

(58) Field of Classification Search ..... 134/186, 134/198, 95.3, 56 R–58 DL
See application file for complete search history.

(56) References Cited

U.S. PATENT DOCUMENTS 3,828,773 A * 8/1974 Buch et al. ..... 128/200.16
3,854,998 A * 12/1974 Jacobs ..... 134/191
4,582,654 A 4/1986 Karnicky et al.
5,485,828 A 1/1996 Hauser
5,865,171 A * 2/1999 Cinquin ..... 128/203.12
6,357,671 B1 * 3/2002 Cewers ..... 239/102.2
6,432,216 B1 * 8/2002 Thies ..... 134/18
6,886,371 B2 5/2005 Arai et al.
7,426,931 B2 * 9/2008 Miyauchi et al. ..... 134/95.3
2004/0256506 A1 * 12/2004 Berger ..... 241/46.013

FOREIGN PATENT DOCUMENTS

| | | | |
|---|---|---|---|
| DE | 197 13 496 | | 10/1998 |
| DE | 19713469 | * | 10/1998 |
| DE | 19713496 | * | 10/1998 |
| EP | 0 487 474 | | 5/1992 |
| EP | 0487474 | * | 5/1992 |
| EP | 1 182 292 | | 2/2002 |
| FR | 2 067 645 | | 8/1971 |

(Continued)

*Primary Examiner*—Michael Kornakov
*Assistant Examiner*—Stephen Ko
(74) *Attorney, Agent, or Firm*—Bacon & Thomas, PLLC

(57) ABSTRACT

A mist generating device includes a mist generation vibrator, and a sealed vessel accommodating therein a fluid and provided at a side of a vibrating surface of the mist generation vibrator. A wall portion which constitutes a part of the sealed vessel and faces the mist generation vibrator has a thin film membrane and a mist of liquid outside the sealed vessel is generated by ultrasonic vibration transmitted from the mist generation vibrator via the fluid in the sealed vessel and the thin film membrane.

19 Claims, 6 Drawing Sheets

FOREIGN PATENT DOCUMENTS

| | | |
|---|---|---|
| FR | 2 746 655 | 10/1997 |
| JP | 61-71340 | 4/1986 |
| JP | 62-138631 | 6/1987 |
| JP | 6-15757 | 3/1994 |
| JP | 6-507836 | 9/1994 |
| JP | 2001-113077 | 4/2001 |
| JP | 2002 011281 | 1/2002 |
| JP | 2003-210378 | 7/2003 |

* cited by examiner

MIST GENERATING DEVICE, AND DISHWASHER AND WASHING MACHINE USING SAME

FIELD OF THE INVENTION

The present invention relates to a mist generating device for generating mist of liquid by a mist generation vibrator, and a dishwasher and washing machine using same.

BACKGROUND OF THE INVENTION

Referring to FIG. 8, there is illustrated a configuration of a conventional dishwasher.

As shown in FIG. 8, dishwasher 801 has washer tub 802 therein, and water or warm water is supplied into washer tub 802 through water supply valve 803. Water drainage outlet 804 is disposed in the bottom portion of washer tub 802, and communicates with washing pump 805 driven by a motor for use in circulating wash water in washer tub 802. Further, strainer 806 for filtering particulate food debris from the wash water is installed in water drainage outlet 804.

Wash water supplied in washer tub 802 is suctioned by washing pump 805 through strainer 806 and is then directed into wash nozzle 807 disposed in the lower portion of washer tub 802 from washing pump 805. Once wash water has been sprayed by wash nozzle 807 onto soiled items 808 to be cleaned (kitchen and dining ware), it is circulated back to water drainage outlet 804 through a water passageway. At this point, solid food particulates removed from items 808 to be cleaned get to strainer 806 in wash water, and any debris too large to pass through strainer 806 are captured in strainer 806.

Further, heater 809 for heating wash water is disposed between wash nozzle 807 and the bottom portion of washer tub 802. Disposed above wash nozzle 807 is rack 810 for arranging items 808 to be cleaned therein in an orderly manner so they can be subjected to more effective spraying of wash water resulting in more efficient cleaning. Moreover, water drain pump 811 is for use in discharging wash water from dishwasher 801 via water drain hose 811*a*. Controller 812 controls electrical components such as water supply valve 803 and washing pump 805 (see, for example, Japanese Patent Laid-Open Application No. 2003-210378).

However, the conventional dishwasher having the above configuration shown in FIG. 8 is not capable of removing all types of food debris stuck on items 808 to be cleaned. Particularly, heavy or stubborn debris which are dried-on or baked-on stuffs remaining on kitchen ware items after preparing certain foods (e.g., gratin or savory steamed egg custard) cannot be removed by the conventional dishwasher.

To solve this problem, it has been proposed to add a prewashing step to allow a detergent solution with a concentration higher than that for use in a normal washing operation to coat and remain on items 808 to be cleaned for a period of time. Adding this step improved the cleaning capability of the conventional dishwasher model, thereby enabling it to remove stubborn or heavy debris it could not before.

In this case, when using, for example, a mist generating device having an ultrasonic vibrator to promote coating of high concentration detergent solution on kitchen or dining ware items to be cleaned, food debris in wash water or mineral dissolved in water with high hardness, (e.g., ground or well water), may deposit and harden thereafter on the vibrating surface of the ultrasonic vibrator. Consequently, such deposits affect the operation of the ultrasonic vibrator by deteriorating its power considerably or causing it to malfunction.

SUMMARY OF THE INVENTION

It is, therefore, an object of the present invention to provide a mist generating device capable of preventing foreign matters from depositing and hardening on a vibrating surface of a mist generation vibrator, and a dishwasher and a washing machine using same.

In accordance with a preferred embodiment of the present invention, there is provided a mist generating device includes: a mist generation vibrator; and a sealed vessel accommodating therein a fluid and provided at a side of a vibrating surface of the mist generation vibrator, wherein a wall portion which constitutes a part of the sealed vessel and faces the mist generation vibrator includes a thin film membrane and a mist of liquid outside the sealed vessel is generated by ultrasonic vibration transmitted from the mist generation vibrator via the fluid in the sealed vessel and the thin film membrane.

BRIEF DESCRIPTION OF THE DRAWINGS

The above and other objects and features of the present invention will become apparent from the following description of a preferred embodiment given in conjunction with the accompanying drawings, in which.

DETAILED DESCRIPTION OF THE PREFERRED EMBODIMENTS

Hereinafter, preferred embodiments of the present invention will be described with reference to the accompanying drawings. Here, it is to be noted that the present invention is not limited thereto.

(First embodiment)

Below, a first preferred embodiment of the present invention is described in conjunction with FIGS. 1 and 2, wherein a mist generating device in accordance with the present invention is applied to a dishwasher.

Figure 1:
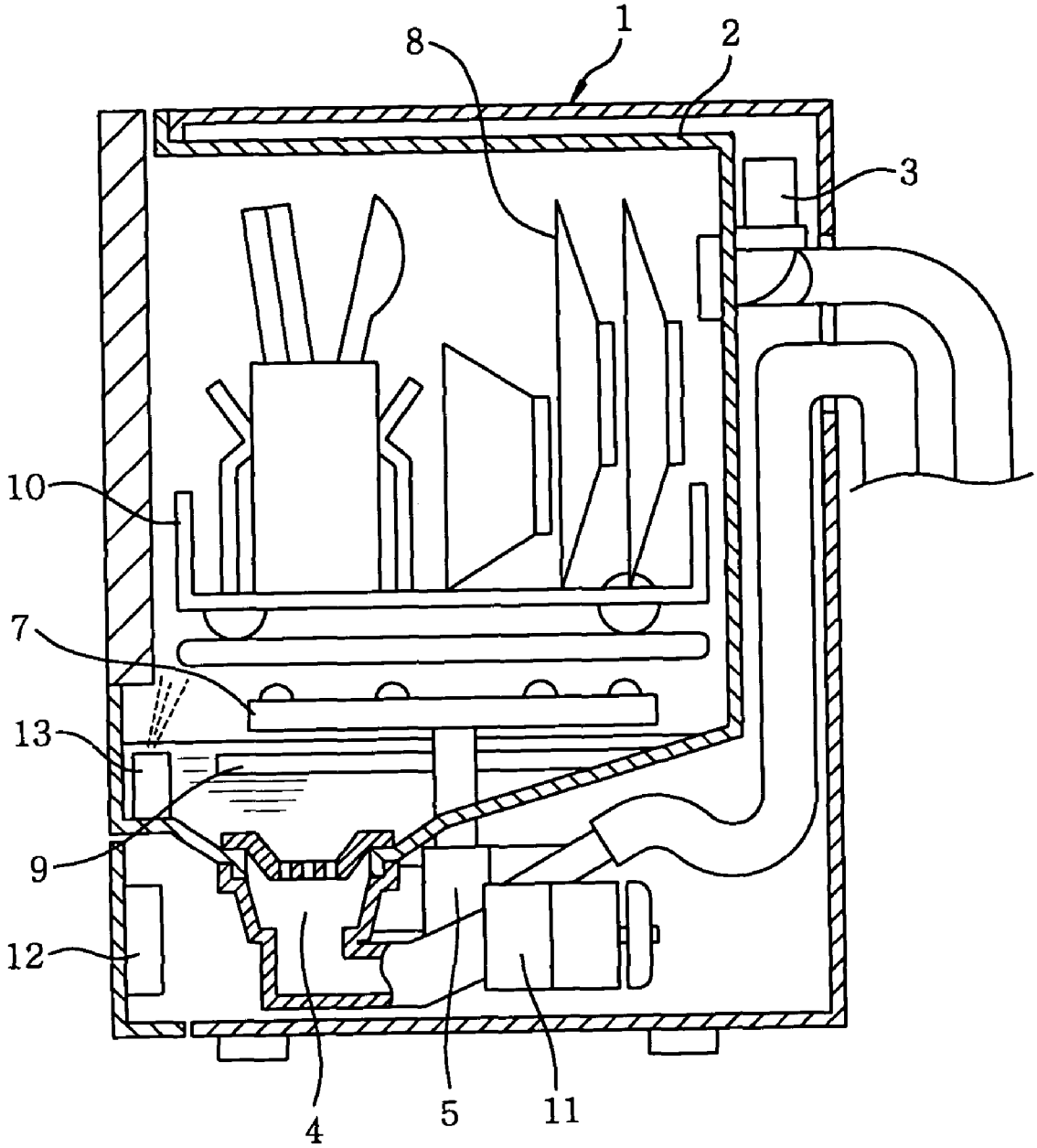
FIG. 1 is a cross sectional view of a dishwasher in accordance with a first preferred embodiment of the present invention.
Figure 2:
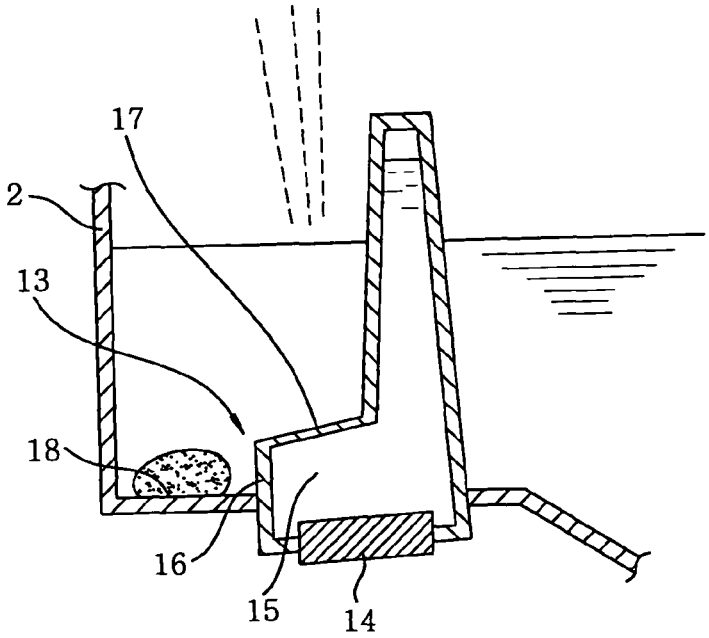
FIG. 2 illustrates a longitudinal cross sectional view of a mist generating device of the dishwasher shown in FIG. 1.

As shown in FIG. 1, dishwasher 1 in accordance with the first preferred embodiment of the present invention includes water drainage outlet 4, washing pump 5, heater 9 for heating wash water, rack 10, water drain pump 11 and controller 12. Under control of controller 12, wash water is heated by heater 9 while being circulated by washing pump 5 via water drainage outlet 4, thereby removing food debris from items 8 to be cleaned (kitchen and dining ware) arranged in rack 10. Thereafter, soiled wash water is discharged from dishwasher 1 by water drain pump 11.

Dishwasher 1 further includes mist generating device 13 disposed at the lower front portion of washer tub 2. As can be seen in FIG. 2, mist generating device 13 includes mist generation vibrator 14 formed of an ultrasonic vibrator disposed at the bottom portion thereof; and sealed vessel 16 containing therein fluid medium 15 resting on the vibrating surface of mist generation vibrator 14. Wall portion 17 of sealed vessel 16 which faces mist generation vibrator 14 is formed of a thin film membrane. The thin film membrane of wall portion 17 is vibrated by mist generation vibrator 14 via fluid medium 15, to thereby generate mists of washing fluid (wash water) outside sealed vessel 16 in washer tub 2. In this embodiment, fluid medium 15 is distilled water. Further, in order to ensure that wall portion 17 is in contact with fluid medium 15 even in case the amount of fluid medium 15 decreases because some of it evaporates through the wall of sealed vessel 16, sealed vessel 16 is shaped such that it contains fluid medium 15 up to its height well above wall portion 17. In this case, sealed vessel 16 is formed of a material with a low water vapor permeability and a low ultrasonic absorptivity. For example, unfilled polyphenylene sulfide may be an optimal material for sealed vessel 16. Further, the thickness of the thin film membrane forming wall portion 17 facing mist generation vibrator 14 is set to be equivalent to about the half of the wavelength of an ultrasonic vibration as it is transmitted through the wall of sealed vessel 16 after being generated by mist generation vibrator 14. In case the thin film membrane of wall portion 17 is made up of unfilled polyphenylene sulfide, its thickness is set to be 0.5 mm or thereabout. Moreover, in order to generate a high-concentration detergent solution above wall portion 17 facing mist generation vibrator 14, detergent dispenser 18 for accommodating detergent therein is disposed in the vicinity of wall portion 17.

The operation and function of the mist generating device 13 having the above configuration will now be described. Since mist generating device 13 is provided with sealed vessel 16 containing therein fluid medium 15 on the side of the vibrating surface of mist generation vibrator 14, mist generation vibrator 14 is prevented from contacting wash water directly by sealed vessel 16. Therefore, in case of operating dishwasher 1, mist generation vibrator 14 does not contact wash water directly, thereby preventing food debris in the form of sludge in soiled wash water from depositing and hardening on the vibrating surface of mist generating device 13. Therefore, it is possible to maintain a stable generation of mist even in soiled wash water without causing mist generating device 14 to malfunction.

Further, in case the conventional mist generating device is used in hard water such as ground or well water even though it does not use heavily soiled wash water in removing food debris from items to be cleaned, mineral dissolved in hard water would deposit on the vibrating surface of the conventional mist generation vibrator. Thus, even in case of using clean water, hard mineral deposits forming on the surface of the conventional mist generation vibrator would deteriorate its performance. However, by using mist generating device 13 in accordance with the present invention, such problem can be avoided, so that mist generation of washing liquid can be stably carried out more reliably for an extended period of time. Accordingly, mist generating device 13 offers many advantages when it is applied to equipment using mist generation vibrator 14 formed of ultrasonic vibrator for the generation of mist of liquid.

Since wall portion 17 of sealed vessel 16 which faces mist generation vibrator 14 is formed of a thin-film membrane, permeability of ultrasonic vibration is greatly improved. Therefore, mist of washing liquid can be generated efficiently, which in turn enhances cleaning efficiency. Moreover, by forming wall portion 17 with thin-film membrane, absorption of ultrasonic vibration energy by sealed vessel 16 can be reduced, which protects the thin film membrane of wall portion 17 from being disintegrated by ultrasonic vibration.

Further, since sealed vessel 16 is formed of a material with a low water vapor permeability and a low ultrasonic absorptivity, a loss of fluid medium 15 due to its permeation through sealed vessel 16 can be reduced, so it becomes unnecessary to replenish fluid medium 15 even in case it is used for an extended period of time. Moreover, since sealed vessel 16 is formed of a material with a low ultrasonic absorptivity, generation of mist can be stabilized, while protecting sealed vessel 16 from being disintegrated by ultrasonic vibration.

In addition, since the thickness of the thin film membrane of wall portion 17 facing mist generation vibrator 14 is set to be equivalent to about a half of the wavelength of an ultrasonic wave as it is transmitted through the thin film membrane of wall portion 17 after being generated by mist generation vibrator 14, maximum permeability of the thin film membrane can be obtained, so that the amount of mists generated can be maximized.

Next, the operation of dishwater 1 will be described. After loading a predetermined amount of detergent into detergent dispenser 18, the operation of dishwasher 1 is started. First, water supply valve 3 is opened under the control of controller 12, and a preset amount of wash water enters washer tub 2. At this time, controller 12 sets and controls the water level such that detergent dispenser 18 is submerged in water.

When wash water flows into detergent dispenser 18, some of detergent is dissolved in the wash water. When mist generation vibrator 14 is activated at that moment, its vibration is transmitted to the thin film membrane of wall portion 17 of sealed vessel 16 via fluid medium 15, to thereby vibrate the thin film membrane. If the thin film membrane is positioned where the amplitude of mist generation vibrator 14 reaches its maximum, the thin film membrane can be vibrated greatly.

The vibration of the thin film membrane of wall portion 17 in turn causes wash water resting above it to pulsate as well thereby generating mists of wash water while dissolving detergent added from detergent dispenser 18 in the wash water. As a result, the wash water highly concentrated with detergent is sprayed into washer tub 2 to coat items 8 to be cleaned. If the water level becomes lower so that wall portion 17 is exposed, the mist generation comes to a halt, and the detergent solution is no more dispersed. Therefore, controller 12 controls water supply valve 3 such that wall portion 17 stays submerged in water while mist generation vibrator 14 is operating.

A pre-washing step is performed prior to the main washing operation. As described above, by spraying a high-concentration detergent solution in washer tub 2 from mist generating device 13, items 8 to be cleaned are coated with detergent solution, and this condition is maintained for a period of time. As a result, food debris remaining on items 8 to be cleaned is chemically disintegrated by the detergent solution.

During the main washing operation, the food debris disintegrated by the above pre-washing process for removing certain types of food debris through the use of high-concentration detergent solution is subjected to washing processes identical to those normally performed by a conventional dishwasher.

Food debris of items 8 to be cleaned can be more efficiently removed by increasing the temperature or the mechanical force of wash water (here, mechanical force referring to the power of jetting wash water from wash nozzle 7). Thus, although certain food debris is disintegrated through the pre-washing process, adjusting the temperature or the mechanical force of wash water may be an option to further improve the cleaning efficiency. However, disintegration of food debris by coating with high-concentration detergent and maintaining of the condition for a period of time during the pre-washing process has demonstrated its effectiveness for removing heavy or stubborn food debris which could not be handled by the conventional dishwasher.

As for mist generating device 13 in accordance with the first preferred embodiment of the present invention, since mist generation vibrator 14 is configured to generate mist of wash water in washer tub 2 via fluid medium 15 and sealed vessel 16, neither does mist generation vibrator 14 contact wash water. Therefore, it is possible to prevent the problems arising from hardened deposits of foreign substances on the vibrating surface of mist generation vibrator 14. For example, the problems of deteriorating the performance of mist generation vibrator 14 by such hardened deposits, causing a considerable reduction in the amount of mist generated or rendering mist generation vibrator 14 inoperable can be prevented. As a result, mist generation of wash water can be reliably carried out even in wash water heavily soiled with, e.g., food debris.

As for dishwasher 1, since mist of wash water for cleaning soiled kitchen and dining ware items is generated by using mist generating device 13 in accordance with the present invention, the generation of mists can be performed stably even in soiled wash water in washer tub 2. Moreover, by using mist generating device 13, it is possible to perform a pre-washing step for spraying a detergent solution, which is of a concentration higher than that for use in a normal washing operation, to coat items 8 to be cleaned almost completely. Furthermore, since cleaning efficiency can be greatly improved from the chemical strength of the high-concentration detergent coating items 8, dishwasher 1 can remove stubborn or heavy debris it could not before; In addition, since the thin film membrane of wall portion 17 facing mist generation vibrator 14 is formed of a material with a low ultrasonic absorptivity, the thin film membrane can be prevented from being disintegrated by ultrasonic vibration generated by mist generation vibrator 14.

Although distilled water is used as fluid medium 15 in the first preferred embodiment of the present invention, any kind of liquid capable of transmitting vibration, e.g., saline water or polypropylene glycol solution, can be used instead.

(Second embodiment)

Below, a second preferred embodiment of the present invention is described with reference to FIG. 3. Here, parts that are identical to those descried in the first embodiment will be assigned same reference numerals and description thereof will be omitted; and instead distinctive parts will be focused on and elaborated.

Figure 3:
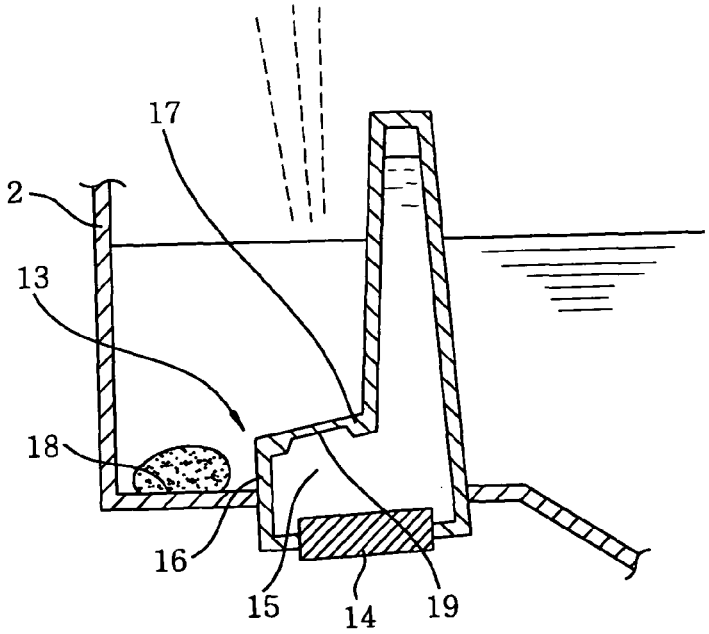
FIG. 3 shows a longitudinal cross sectional view of a mist generating device in accordance with a second preferred embodiment of the present invention.

As for mist generating device 13 in accordance with the second embodiment of the present invention shown in FIG. 3, wall portion 17 of sealed vessel 16 which faces mist generation vibrator 14 is provided with recessed portion 19 on its side contacting fluid medium 15, wherein recessed portion 19 serves as a thin film membrane. Specifically, recessed portion 19 is formed by compressing a part of wall portion 17 in its thickness direction after injecting a resin in the course of injection molding sealed vessel 16.

In the above configuration, since the thin film membrane is implemented by recessed portion 19 formed on wall portion 17 facing mist generation vibrator 14, the wall portion 17 of sealed vessel 16 through which ultrasonic vibration is to be transmitted can be formed thinner even though sealed vessel 16 is fabricated by using a resin with a poor fluidity. As a result, absorption of ultrasonic waves can be reduced, and generation of mist can be stabilized without causing sealed vessel 16 to be disintegrated by the ultrasonic waves.

Furthermore, since recessed portion 19 is formed on wall portion 17 by compressing a part of wall portion 17 in its thickness direction after injecting a resin in the course of injection molding sealed vessel 16, wall portion 17 can be designed to have a thin film membrane even if it is formed of a material with poor fluidity. Consequently, absorption of ultrasonic waves can be reduced and stable mist generation can be achieved without causing sealed vessel 16 to be disintegrated by the ultrasonic waves.

(Third embodiment)

Below, a third preferred embodiment of the present invention is described with reference to FIG. 4.

Figure 4:
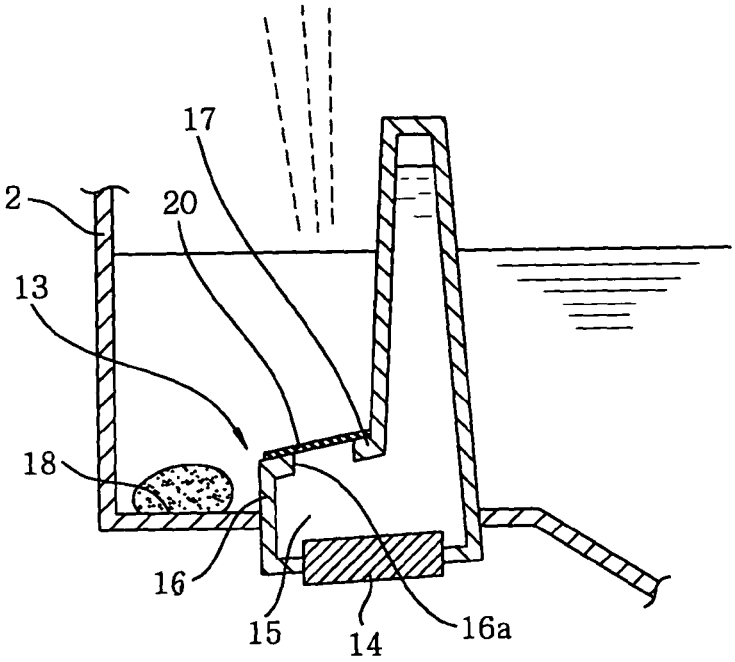
FIG. 4 sets forth a longitudinal cross sectional view of a mist generating device in accordance with a third preferred embodiment of the present invention.

As shown in FIG. 4, mist generating device 13 in accordance with the third embodiment of the present invention has sealed vessel 16 whose wall portion 17 facing mist generation vibrator 14 is provided with opening 16*a* which is hermetically closed by sheet-shaped resin 20. Here, sheet-shaped resin 20 serves as a thin film membrane.

In the above configuration, since the thin film membrane is implemented by sheet-shaped resin 20 covering opening 16*a* formed in sealed vessel 16's wall portion 17 facing mist generation vibrator 14, it is possible to form the thin film membrane, which allows ultrasonic vibration to pass therethrough easily, on wall portion 17 even in case sealed vessel 16 is formed of a resin with a poor fluidity. Further, by forming the thin film membrane with sheet-shaped resin 20 which features a low ultrasonic absorptivity, generation of mist can be stabilized without causing sealed vessel 16 to be disintegrated by ultrasonic waves.

(Fourth Embodiment)

Figure 5:
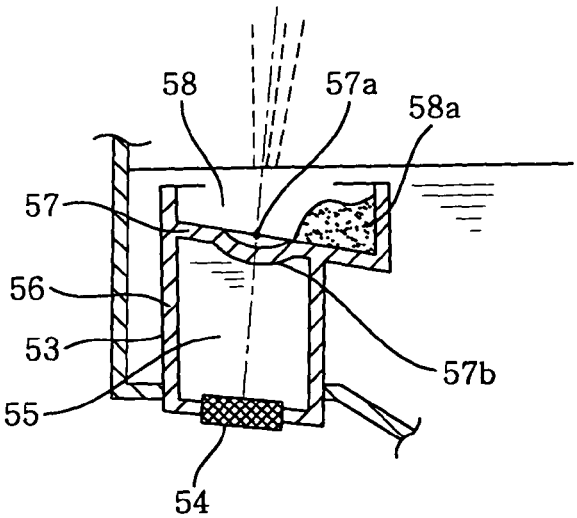
FIG. 5 presents a longitudinal cross sectional view of a mist generating device in accordance with a fourth preferred embodiment of the present invention.

FIG. 5 presents a cross sectional view to show a mist generating device installed in a washer tub containing wash water therein in accordance with a fourth preferred embodiment of the present invention.

As shown in FIG. 5, mist generating device 53 includes sealed vessel 56 containing therein fluid medium 55 and mist generation vibrator 54 formed of an ultrasonic vibrator disposed at the bottom portion of sealed vessel 56. Sealed vessel 56's top wall portion 57 positioned to face mist generation vibrator 54 at the bottom portion of sealed vessel 56 corresponds to wall portion 17 in the first embodiment described above. That is to say, top wall portion 57 is vibrated by ultrasonic vibration transmitted from mist generation vibrator 54 via fluid medium 55 when mist generation vibrator 54 is operating. Further, fluid medium 55 contained in sealed vessel 56 is preferably distilled water.

In this case, top wall portion 57 is inclined as shown in FIG. 5, and is formed of a resin which vibrates easily. Further, top wall portion 57 is provided with arc-shaped concave portion 57*b* formed symmetrically with respect to center 57*a* of the transmission path of vibration of mist generation vibrator 54 (i.e., the portion of top wall portion 57 intersecting the vertical line passing through the center of mist generation vibrator 54). Furthermore, detergent dispenser 58 for accommodating detergent 58*a* therein is disposed over top wall portion 57.

The operation and function of mist generating device 53 with the above-described configuration will now be described.

When mist generation vibrator 54 is operated, vibration of mist generation vibrator 54 is transmitted to top wall portion 57 via fluid medium 55, to thereby vibrate top wall portion 57. The vibration of top wall portion 57 in turn causes wash water resting above it to pulsate as well thereby generating mists of wash water.

As for mist generating device 53 in accordance with the fourth preferred embodiment of the present invention described above, since fluid medium 55 contained in sealed vessel 56 is disposed above mist generation vibrator 54 while being isolated from wash water directly, neither does mist generation vibrator 54 contact wash water. Therefore, though mist generating device 53 is installed in equipment that handles heavily soiled wash water such as a dishwasher in such a way that its top wall portion 57 is submerged in soiled wash water, it is possible to prevent food debris in the form of sludge from depositing and hardening thereafter on the vibrating surface of mist generation vibrator 54.

For example, the problems of deteriorating the performance of mist generation vibrator 54 by such hardened deposits, causing a considerable reduction in the amount of mist generated or rendering mist generation vibrator 54 inoperable can also be avoided. As a result, mist generation of wash water can be reliably carried out even in wash water heavily soiled with, e.g., food debris for an extended period of time.

Further, in case mist generating device 53 is used in hard water such as ground or well water though it does not handle heavily soiled wash water in, e.g., dishwasher, mineral dissolved in hard water would deposit on the vibrating surface of the mist generation vibrator 54, thus deteriorating its performance. However, by using mist generating device 53 in accordance with the present invention, such problem can be avoided, so that mist generation of washing liquid can be stably carried out more reliably for an extended period of time. Therefore, mist generating device 53 offers many advantages when it is applied to equipment using mist generation vibrator 54 for the generation of mists of liquid.

In case air bubbles are generated in fluid medium 55 inside sealed vessel 56, while lying below the central portion of top wall portion 57, they would obstruct the transmission of vibration from mist generation vibrator 54 to top wall portion 57. Therefore, top wall portion 57 is inclined so that the air bubbles are directed to stay away from the center of the transmission path of vibration. Moreover, since top wall portion 57 is provided with concave portion 57*b*, the amount of mists of highly concentrated detergent solution generated can be increased compared to the case of using a flat surface, for concave shape allows the vibration energy of mist generation vibrator 54 to be concentrated more centrally than flat surface does.

Also, with regard to mist generating device 53, since top wall portion 57 of sealed vessel 56 is made of resin, it is possible to obtain stable vibrations by way of utilizing a resin material capable of producing a vibrational state similar to that of fluid medium 55 in sealed vessel 56. Further, since top wall portion 57 is provided with concave portion 57*b*, the vibration energy of mist generation vibrator 54 can be concentrated centrally for the more efficient use thereof. As a result, stable mist generation can be maintained and the amount of mists generated can be increased.

Although distilled water is used as fluid medium 55 contained in sealed vessel 56 in the fourth preferred embodiment of the present invention, any kind of liquid capable of transmitting vibration, e.g., saline water, can be used instead as long as it is preferably incorruptible and inexplosive. Further, though top wall portion 57 of mist generating device 53 is made of a resin which tends to vibrate easily, it is also possible to form top wall portion 57 even with a metal as long as it vibrates by the influence of mist generation vibrator 54. In addition, although concave portion 57*b* is provided in top wall portion 57, it is acceptable to make its inner side flat but its outer side (exposed to wash water) in a concave shape like a typical concave lenses. Accordingly, only the outer side of sealed vessel is concave shaped so that the vibration energy can be concentrated centrally more efficiently.

(Fifth embodiment)

Below, a fifth preferred embodiment of the present invention is described with reference to FIGS. 6 and 7, wherein a mist generating device in accordance with the present invention is applied to a washing machine.

Figure 6:
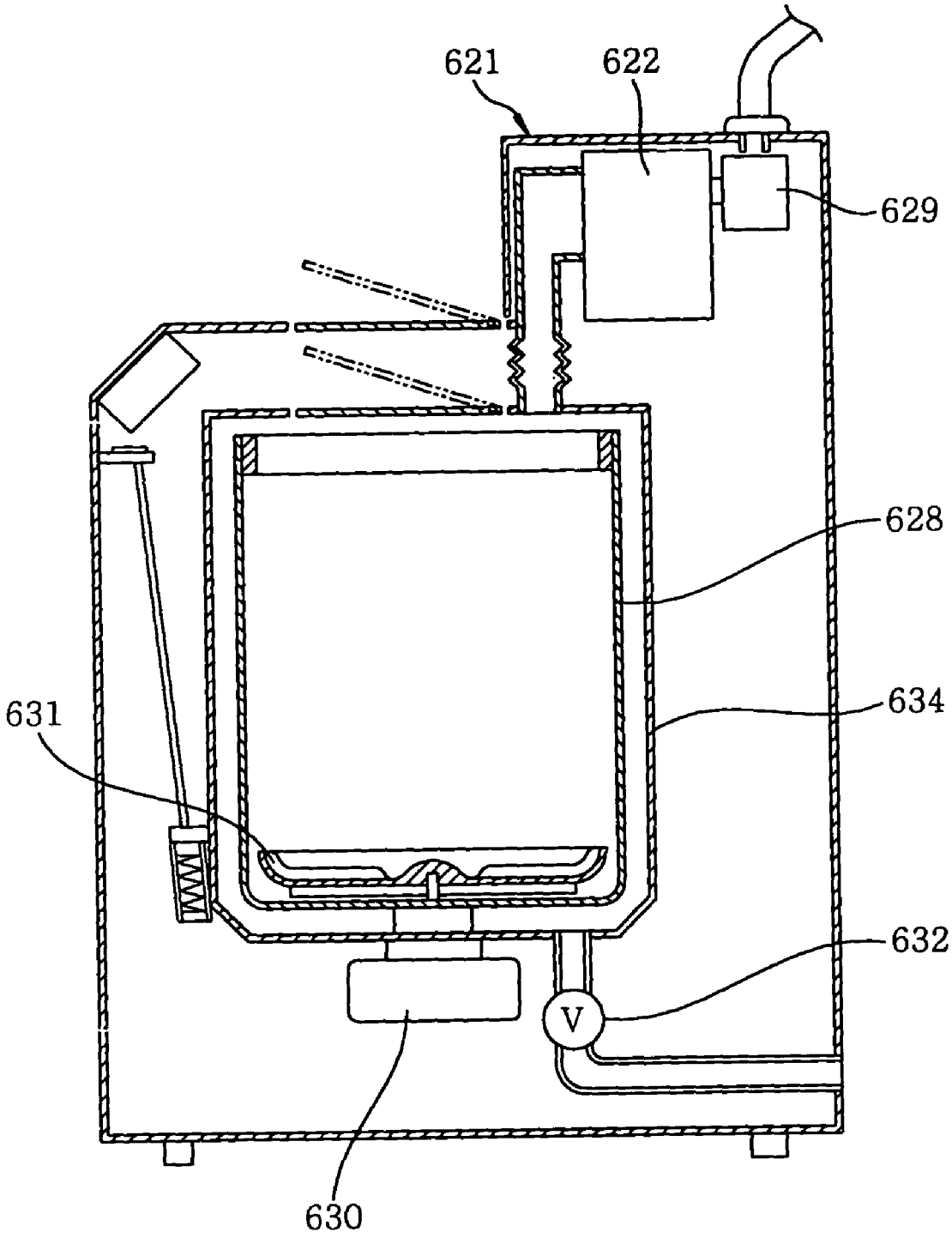
FIG. 6 depicts a cross sectional view of a washing machine in accordance with a fifth preferred embodiment of the present invention.
Figure 7:
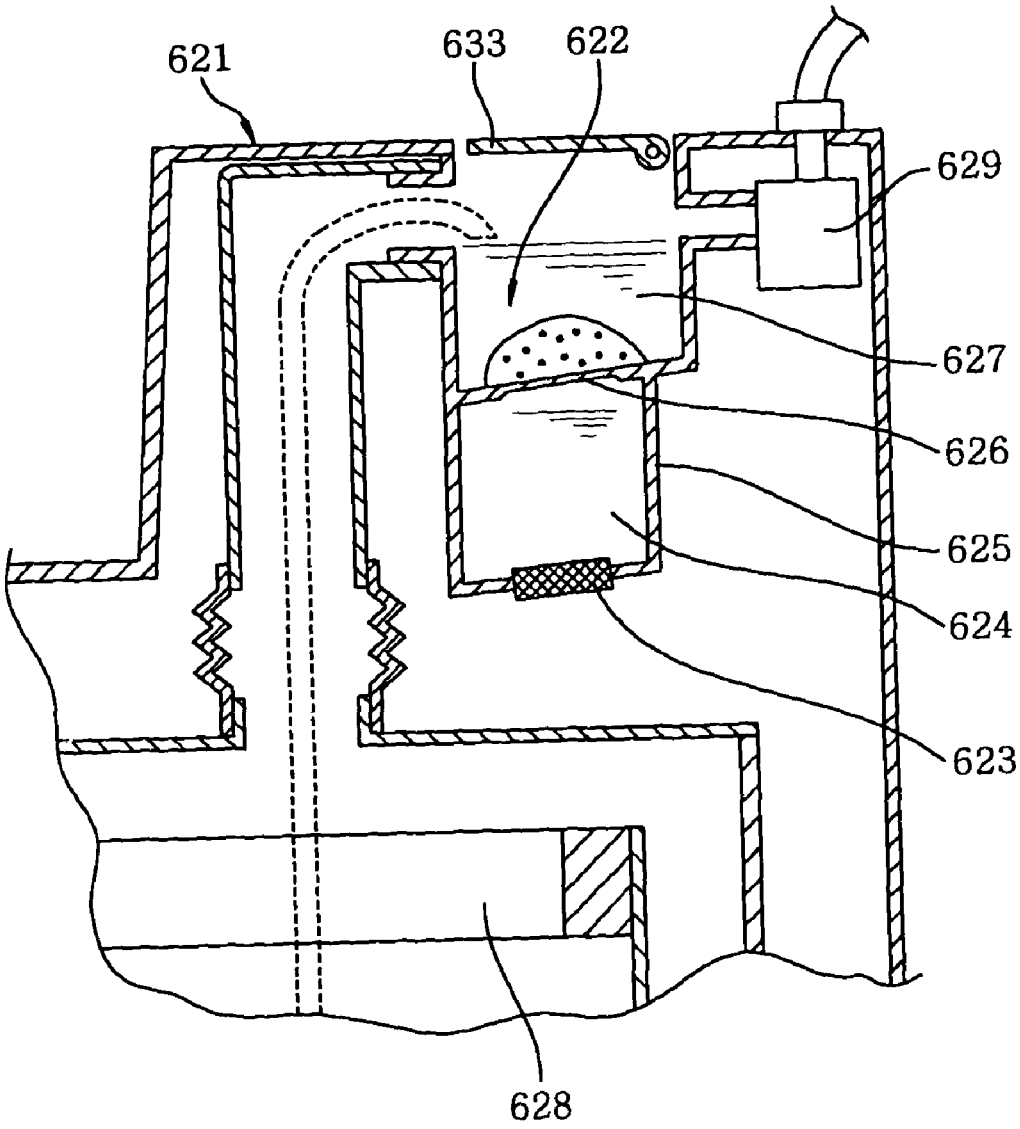
FIG. 7 is an enlarged cross sectional view of a major component of the washing machine shown in FIG. 6.
Figure 8:
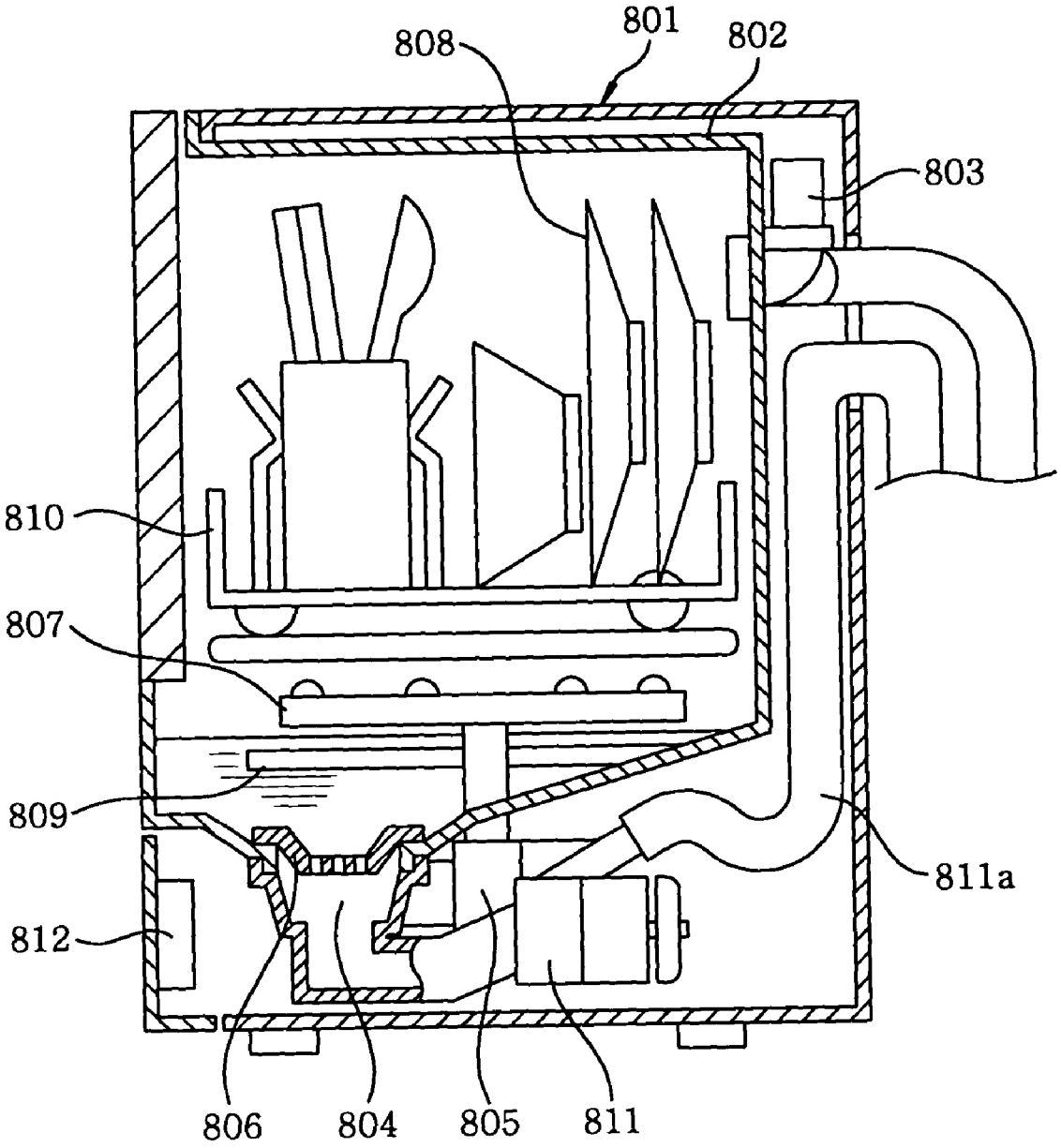
FIG. 8 (PRIOR ART)
FIG. 8 shows a longitudinal cross sectional view of a conventional dishwasher.

Washing machine 621 in accordance with the fifth embodiment of the present invention includes mist generating device 622 disposed in a main body thereof, as shown in FIG. 6. As can be seen in FIG. 7, mist generating device 622 includes mist generation vibrator 623 formed of an ultrasonic vibrator disposed at the bottom portion thereof; and sealed vessel 625 containing therein fluid medium 624 resting on the vibrating surface of mist generation vibrator 623. Thin film membrane 626 formed in sealed vessel 625's wall portion which faces mist generation vibrator 623 is vibrated by mist generation vibrator 623 via fluid medium 624, to thereby generate mists of washing liquid (wash water) outside sealed vessel 625.

Furthermore, detergent dispenser 627 for accommodating detergent therein is disposed over the top of thin film membrane 626 facing mist generation vibrator 623. In this case, thin film membrane 626 is formed of a material which vibrates easily and is inclined. In this embodiment, fluid medium 624 is distilled water.

The operation and function of the mist generating device having the above configuration will be described hereinbelow. First, the operation and function of washing machine 621 will be described in advance. If a washing process is started after loading laundry in inner tub 628, water supply valve 629 is opened, so that fresh wash water is supplied into inner tub 628 up to a predetermined water level. Then, motor 630 is driven, and pulsator 631 is rotated by the driving force transmitted from motor 630 via a washing shaft. By the rotation of pulsator 631, the laundry in inner tub 628 is agitated and is therefore washed.

Upon completion of the washing operation, water drain valve 632 is opened to discharge soiled wash water externally. Thereafter, a rinsing process is started by supplying fresh wash water again, wherein the laundry is rinsed through the operations identical to those performed in the washing process.

After the rinsing process, water drain valve 632 is opened to exhaust water from inner tub 628, and then a water-extracting process is begun. In the water-extracting process, the driving force of motor 630 is transmitted to inner tub 628 via the washing shaft, to thereby rotate inner tub 628 and extract water from the laundry by centrifugal force.

In accordance with the fifth preferred embodiment, a prewashing step is added to the-above described operations of washing machine 621. After opening lid 633 of detergent dispenser 627, detergent is loaded therein and lid 633 is maintained closed. If a washing process is started after loading laundry (cloths to be washed) in inner tub 628, tap water (wash water) enters detergent dispenser 627 through water supply valve 629. The duration of this water supplying operation is determined such that detergent dispenser 627 is filled with water almost completely. Even in case the amount of supplied tap water is excessive, the water may overflow detergent dispenser 627, so that the water level in detergent dispenser 627 is regularly maintained. At this moment, some of detergent starts to be dissolved in water.

If mist generation vibrator 623 is activated at the moment, its vibration is transmitted to thin film membrane 626 of sealed vessel 625 which faces mist generation vibrator 623. via fluid medium 624, to thereby vibrate thin film membrane 626. If thin film membrane 626 is positioned where the amplitude of mist generation vibrator 623 reaches its maximum, thin film membrane 626 can be vibrated greatly.

The vibration of thin film membrane 626 in turn causes the wash water resting above it to pulsate as well thereby generating mists of wash water while dissolving detergent added from detergent dispenser 627 in wash water. As a result, wash water highly concentrated with detergent can be dispersed.

The wash water containing therein detergent in the form of mist, namely, highly concentrated detergent solution is dispersed into inner tub 628, so that the laundry in inner tub 628 is coated with detergent solution in the form of mist almost completely. Then, by maintaining this condition for a period of time, soils clinging to the laundry are chemically disintegrated by the detergent solution. Thereafter, a series of normal operations of washing machine including washing, rinsing and water-extracting processes are performed.

The fifth embodiment of the present invention relates to mist generation of fresh wash water, not heavily soiled wash water. In case of using hard water such as ground or well water, mineral dissolved in hard water would deposit on the vibrating surface of mist generation vibrator 623, as described earlier, but mist generating device 622 in accordance with the fifth embodiment of the present invention may be useful even in this case, thereby making it possible to carry out mist generation of washing liquid stably and reliably for an extended period of time.

As described above, since washing machine 621 in accordance with the fifth embodiment of the present invention includes mist generating device 622 to generate mist of wash water, mist generation can be performed stably even in wash water. Furthermore, by adding a pre-washing step to allow a detergent solution, which is of a concentration higher than that for use in a normal washing operation, to completely coat and remain on laundry for a period of time, the cleaning efficiency greatly can be improved considerably by virtue of the chemical strength of the high-concentration detergent coating the laundry.

Though mist generating device 622 is installed inside the main body of washing machine 621 and wash water is supplied into detergent dispenser 627 through water supply valve 629 in accordance with the fifth embodiment of the present invention, it is also possible to obtain same function and effect by disposing mist generating device 622 in outer tub 634 accommodating inner tub 628 therein and allowing wash water in outer tub 634 to enter detergent dispenser 627, to thereby generate mist of high-concentration detergent solution and disperse it into inner tub 628 to coat the laundry therein.

As described above, the mist generating device in accordance with the present invention is capable of preventing foreign matters from depositing and hardening on the vibrating surface of the mist generation vibrator. Therefore, it is possible to prevent the problems arising from hardened deposits of foreign matters on the vibrating surface of the mist generation vibrator: the problems of deteriorating the performance of the mist generation vibrator by such hardened deposits, causing a considerable reduction in the amount of mist generated or rendering the mist generation vibrator inoperable. As a result, mist generation of wash water can be reliably carried out even in hard water or heavily contaminated washing liquid. Thus, the present invention can offer advantages when it is applied to a dishwasher or a washing machine, while improving their cleaning efficiency greatly.

While the invention has been shown and described with respect to the preferred embodiments, it will be understood by those skilled in the art that various changes and modifications may be made without departing from the spirit and scope of the invention as defined in the following claims.

What is claimed is:

1. A dishwasher having a mist generating device for generating mist of wash water for cleaning kitchen and dining ware items wherein the mist generating device comprises:

a mist generation vibrator; and a sealed vessel accommodating therein a fluid and provided at a side of a vibrating surface of the mist generation vibrator, wherein the sealed vessel includes a top wall portion which faces the mist generation vibrator, wherein the sealed vessel further includes a side wall portion which is substantially vertical, wherein the top wall portion has a thin film membrane and a mist of liquid outside the sealed vessel is generated by ultrasonic vibration transmitted from the mist generation vibrator via the fluid in the sealed vessel and the thin film membrane, wherein a detergent dispenser for accommodating detergent therein is disposed in the vicinity of the top wall portion, wherein the thin film membrane faces the mist generation vibrator and is inclined in one direction, and wherein the thin film membrane is provided with an arc-shaped concave portion which is formed symmetrically with respect to a portion where the inclined thin film membrane intersects a line normally passing through a center of the mist generation vibrator.

2. The dishwasher of claim 1, wherein the sealed vessel is formed of a material with a low permeability of the fluid and a low absorptivity of the ultrasonic vibrations.

3. The dishwasher of claim 2, wherein a thickness of the thin film membrane is set to be about half of a wavelength of the ultrasonic vibration being transmitted through the sealed vessel after having been generated by the mist generation vibrator.

4. The dishwasher of claim 2, wherein the concave portion is curved toward the mist generation vibrator.

5. The dishwasher of claim 4, wherein the concave portion is formed at an inner side of the thin film membrane, the inner side facing the mist generation vibrator.

6. The dishwasher of claim 4, wherein the concave portion is formed at an outer side of the thin film membrane, the outer side opposing the mist generation vibrator.

7. The dishwasher of claim 4, wherein the thin film membrane is formed by compressing the top wall portion in a thickness direction thereof after injecting a resin in a course of injection molding the sealed vessel.

8. The dishwasher of claim 2, wherein the thin film membrane is formed of a resin.

9. The dishwasher of claim 1, wherein a thickness of the thin film membrane is set to be about half of a wavelength of the ultrasonic vibration being transmitted through the sealed vessel after having been generated by the mist generation vibrator.

10. The dishwasher of claim 1, wherein the concave portion is curved toward the mist generation vibrator.

11. The dishwasher of claim 10, wherein the concave portion is formed at an inner side of the thin film membrane, the inner side facing the mist generation vibrator.

12. The dishwasher of claim 10, wherein the concave portion is formed at an outer side of the thin film membrane, the outer side opposing the mist generation vibrator.

13. The dishwasher of claim 10, wherein the thin film membrane is formed by compressing the top wall portion in a thickness direction thereof after injecting a resin in a course of injection molding the sealed vessel.

14. The dishwasher of claim 1, wherein the thin film membrane is formed of a resin.

15. The dishwasher of claim 1, wherein the sealed vessel is formed of unfilled polyphenylene.

16. The dishwasher of claim 1, wherein the thin film membrane is formed of unfilled polyphenylene sulfide.

17. The dishwasher of claim 1, wherein the dishwasher further comprises a controller which controls water supply such that the top wall portion stays submerged in water while the mist generation vibrator is operating.

18. The dishwasher of claim 1, wherein the thin film membrane directs air bubbles to stay away from a center of a transmission path of the ultrasonic vibration.

19. The dishwasher of claim 1, wherein an inner side of the thin film membrane exposed to the fluid medium is flat, while an outer side of the thin film membrane exposed to the wash water is in a concave shape to form the concave portion.

* * * * *